US005333892A

United States Patent [19]

Stritzl et al.

[11] Patent Number: 5,333,892

[45] Date of Patent: Aug. 2, 1994

[54] DEVICE FOR A SKI BINDING

[75] Inventors: Karl Stritzl; Helmut Wladar, both of Vienna; Andreas Janisch, Oeyenhausen; Hubert Wuerthner, Hainburg/Donau; Gottfried Steiner, Knittelfeld/Wyern, all of Austria

[73] Assignee: HTM Sport -und Freizeitgeraete Aktiengesellschaft, Schwechat, Austria

[21] Appl. No.: 952,847

[22] PCT Filed: Mar. 25, 1992

[86] PCT No.: PCT/EP92/00655

§ 371 Date: Nov. 24, 1992

§ 102(e) Date: Nov. 24, 1992

[87] PCT Pub. No.: WO92/17249

PCT Pub. Date: Oct. 15, 1992

[30] Foreign Application Priority Data

Mar. 28, 1991 [AT] Austria ..... 685/91

[51] Int. Cl.[5] ..... A63C 9/08

[52] U.S. Cl. ..... 280/625; 280/628; 280/634

[58] Field of Search ..... 280/625, 626, 628, 629, 280/633, 634

[56] References Cited

U.S. PATENT DOCUMENTS

| | | | |
|---|---|---|---|
| 3,943,882 | 3/1976 | Sollak et al. . | |
| 4,087,114 | 5/1978 | Czosz | 280/629 X |
| 4,294,462 | 10/1981 | Svoboda et al. | 280/634 |
| 4,593,928 | 6/1986 | Scheck et al. | 280/625 |
| 4,784,404 | 12/1990 | Kowatsch | 280/629 |
| 4,889,359 | 12/1989 | Kowatsch et al. | 280/629 |
| 4,974,869 | 12/1990 | Muhlberger et al. | 280/628 X |
| 5,040,820 | 8/1991 | Rigal et al. | 280/625 |

FOREIGN PATENT DOCUMENTS

| | | | |
|---|---|---|---|
| 0387524 | 7/1088 | Austria . | |
| 0338154 | 8/1088 | Austria . | |
| 2714125 | 10/1977 | Fed. Rep. of Germany | 280/625 |
| 2554358 | 5/1985 | France | 280/628 |
| 2631244 | 11/1989 | France . | |

OTHER PUBLICATIONS

Salomon Catalogue 90–91, p. 20.

*Primary Examiner*—Brian L. Johnson
*Attorney, Agent, or Firm*—Flynn, Thiel, Boutell & Tanis

[57] ABSTRACT

A front jaw having a device for indicating predetermined release values, which front jaw has a housing and a sleeve which is longitudinally adjustable with respect to the housing against the force of a release spring supported on the housing. The sleeve is fastened to one end of a pull rod, the other end of the pull rod carrying a release plate under which short lever arms of two toggle levers grip. The housing has an essentially rectangular recess therein and a window in this recess, with the window enabling the reading of release values indicated by a pointer. The device indicates an exact release value even when the sleeve experiences a change in position relative to the housing during a stepping in with a ski shoe. The sleeve includes an upper surface facing the scale which includes an arrangement for slidably engaging the pointer which is associated with both an engaging device and the scale.

15 Claims, 5 Drawing Sheets

DEVICE FOR A SKI BINDING

FIELD OF THE INVENTION

The invention relates to a device for visually indicating an adjustment number on a front jaw.

BACKGROUND OF THE INVENTION

Such a front jaw is known from AT-PS 387 524. A pointer in this front jaw is provided as a mark formed on a sleeve biassed by a release spring. A scale is provided on a slide member fixedly connected to a pull rod. A slotted hole is provided in a section of the slide member, which section has the scale. The pointer is able to move along the slotted hole. The set value of the adjustment number is thereby constant independent of whether a ski shoe is or is not in the ski binding.

However, what is disadvantageous in this known embodiment is the fact that the scale, viewed in elevational direction, is spaced from a window inserted into a housing, which window often fogs up during use due to temperature fluctuations and thus prevents a satisfactory reading of the set value. The window, which is only schematically indicated in the mentioned reference, is included in the described manner in all products manufactured according to this patent.

Furthermore, a front jaw has become known which has a housing and a sleeve adjustable with respect to the housing and forming a pointer, with the housing having an essentially rectangular recess and in the recess a window, and having in the area of the recess a scale extending in transverse direction of the ski. The sleeve is simultaneously utilized as an abutment for the release spring. The tip of the shoe is thereby held by two sole holders rigidly connected with one another (see Salomon catalogue 90–91, Page 20).

The entire housing is pivoted about a vertical ski-fixed bolt during a release operation. The release spring is thereby loaded at its end surface facing the bolt. Since the sleeve is screwed into the housing, a relative movement does not take place between these structural parts. Due to this design of the front jaw, it is possible for the indicating device to consist of the sleeve acting as the pointer and of an angled scale on the housing.

If, however, a front jaw with two laterally outwardly swingable toggle levers is used, which toggle levers grip with their shorter lever arms behind a release plate loaded through a pull rod by a spring, a so-called release spring, with the pull rod being held at its other end in a longitudinally movable sleeve supported in the housing of the front jaw, and with the spring being supported at one end on a crosswall of the housing and at the other end on the sleeve, there occurs a movement of the sleeve in a longitudinal direction of the ski during insertion of the ski shoe into the front jaw. A value deviating from the set value is thus indicated on a scale mounted on the housing. Such a front jaw is published, for example, in DE-OS 37 20 440.

A further front jaw is shown in AT-PS 338 154, in which the scale, however, is not arranged fixed to the housing, but on a movable structural part. This front jaw is further removed from the already discussed state of the art.

Similarly acting front jaws are furthermore disclosed in the following references:

The front jaw according to EP-A2 0 331 886 has a housing in which a slide member is guided in longitudinal direction. The slide member is fixedly connected to a pull rod which is loaded by an adjustable release spring. A window with a dial is provided in the slide member. The shoulder of a sleeve is associated with the window, which sleeve is loaded by the release spring. The initial tension of the release spring can be changed with an adjusting nut.

A similar front jaw is shown in FR-OS 2 631 244 also mentioned in the search report. Here too is provided a slide member on the inside of a housing, which slide member is loaded by a release spring through a pull rod. The initial tension of the release spring can be changed by means of an adjusting nut resting on a sleeve. The strength of the initial tension can be read on a window of the slide member which carries a dial and in which a shoulder of the sleeve is guided.

Another type of an adjusting device is illustrated in FR-OS 2 234 019. The adjusting of the release spring is indicated in the exemplary embodiments described in this reference by a leaf spring, which is designed as a pointer. According to FIGS. 1 and 2 in this reference, the leaf spring is loaded in direction of its axis so that it is bent arch-like. Whereas, in the embodiment according to FIG. 3, the leaf spring is rivetted at one end to a housing. The leaf spring is bent by the shoulder of an adjusting screw which is used to adjust the initial tension of the release spring. Finally, the leaf spring is, in the exemplary embodiment according to FIG. 4, hingedly supported on a housing wall. An adjusting screw is provided in the wall of the housing laterally spaced from the bearing block, which screw is rotatably supported, however, secured against an axial movement, in the housing wall. This adjusting screw carries an axially adjustable ring, the one edge of which rests on the leaf spring. The leaf spring is further more under the influence of a pressure spring, the other end of which is anchored in the housing. The leaf spring carries a pointer at the end opposite the bearing block, which pointer is provided below a window in the housing. The operation of this embodiment corresponds approximately to FIG. 3 of this reference.

SUMMARY OF THE INVENTION

The purpose of the invention is to provide an indicating device for a front jaw of the abovedescribed type having a holding system for a ski shoe, which indicating device has the advantages of a scale fixedly arranged on the housing. A satisfactory reading of the predetermined adjustment number is therefore also possible in systems in which a relative movement takes place between the sleeve and the scale fastened on the housing. Due to the fact that the sleeve, which moves with the adjustment of the release spring in longitudinal direction of the front jaw, has on its end facing the scale a surface extending at an angle with respect to a longitudinal axis of the housing, and that a pointer is associated with both this surface and also the scale, the-movement of the sleeve taking place in longitudinal direction of the front jaw is converted, for the purpose of indication, into a movement taking place in a transverse direction of the ski. The scale can in this manner be arranged on the housing without causing different values to be indicated when a ski shoe is inserted or not inserted. Due to the fact that the scale is arranged directly on the window, any fogging up of the window is with certainty also prevented.

BRIEF DESCRIPTION OF THE DRAWINGS

The drawings show exemplary embodiments of the front jaw of the invention.

FIG. 11 is an isometric view of a free end portion of a further embodiment of the pointer.

DETAILED DESCRIPTION

Figure 1:
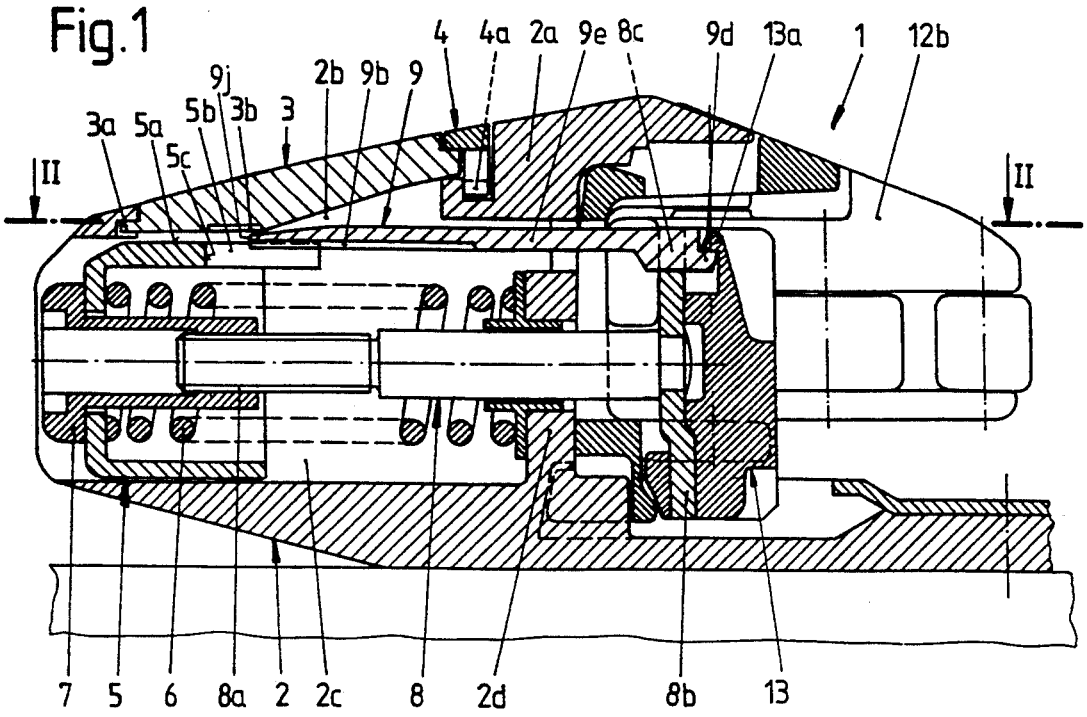
FIG. 1 is a vertical longitudinal center cross-sectional view of a first embodiment, and FIG. 2 a cross-sectional view taken along the line II—II of FIG. 1, with the initial tension of the release spring being adjusted to the value 3.
Figure 2:
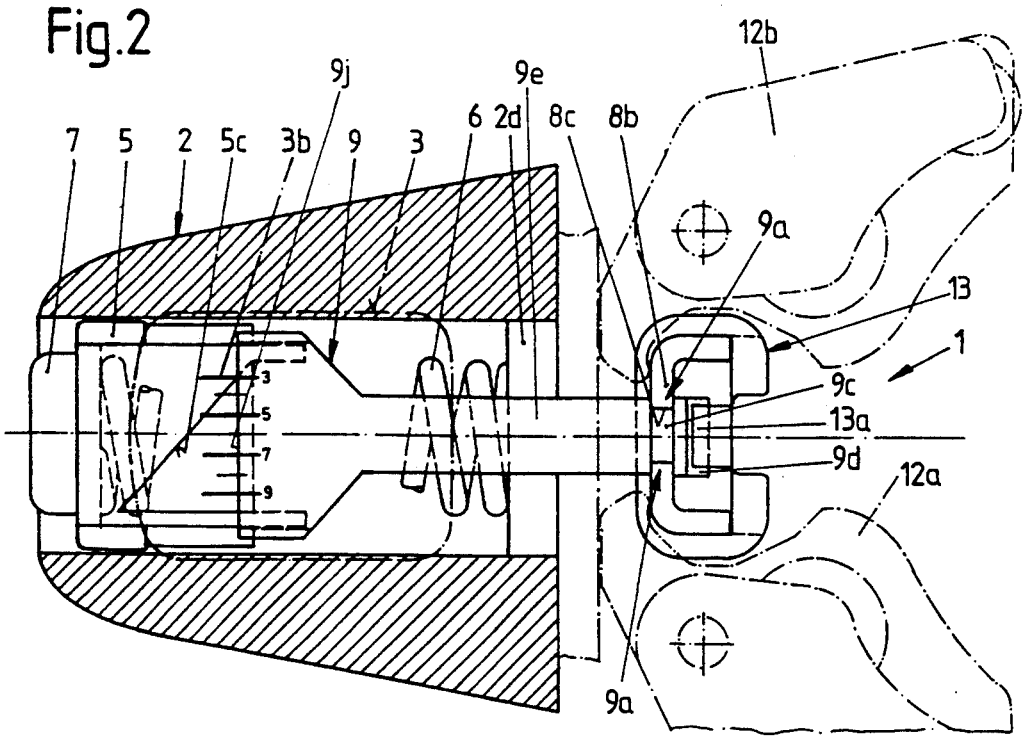
FIG. 2*a* shows a detail of FIG. 2, with the initial tension of the release spring being adjusted to the value 5 and the ski shoe not yet inserted.
FIG. 2*b* shows the same detail, however, the ski shoe is already inserted.
Figure 2A:
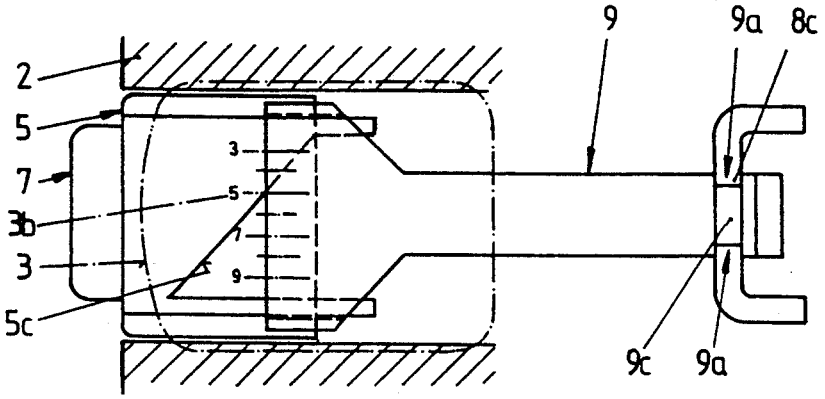

A ski binding part constructed as a front jaw is identified in its entirety by the reference numeral 1 in FIGS. 1 and 2. It has a housing 2 which includes a rectangular recess 2*b* in its upper side 2*a*. A window 3 made of a transparent plastic is inserted into the recess 2*b*. A projection 3*a* provided on the window grips under one edge of the recess 2*b*, whereas the opposite side of the window 3 is held in place by an approximately U-shaped holding part 4 made of an elastic material, which holding part extends in a transverse direction such that legs 4*a*, provided on the holding part 4 and which are designed as hooks, are received in corresponding recesses in the housing 2. A scale 3*b* extends in transverse direction and is etched into the underside of the window 3.

The housing 2 has a bore 2*c* extending therethrough in longitudinal direction of the ski, in which bore is movably supported a cuplike sleeve 5, however, is secured against rotation. This sleeve 5 defines an abutment bracket for a release spring 6. An adjusting nut 7 is rotatably support in the sleeve 5. The sleeve 5 is connected to a threaded section 8*a* of a pull rod 8. An end of the release spring 6, which end is remote from the sleeve 5, is supported on a wall 2*d* of the housing 2, through which wall extends the pull rod 8. Such a design of a front jaw is actually known and is not part of the subject matter of the present invention.

Figure 12:
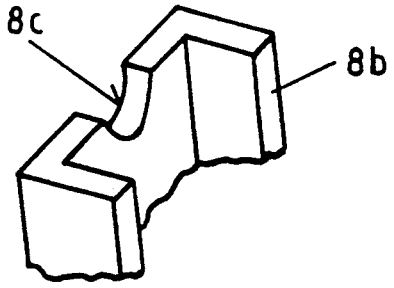
FIG. 12 is an isometric view of the upper edge of the release plate and the upwardly open notch thereat.

An upper side 5*a* of the sleeve 5 includes a tongue or tine 5*b* extending in direction of an axis of the release spring 6 and is defined by an edge surface or intermediate edge or intermediate edge portion 5*c* extending at an angle with respect to the mentioned axis. A release plate 8*b* is riveted to the pull rod 8. The release plate 8*b* has at its upper end an upwardly open notch 8*c* (FIG. 12), into which notch is inserted a necked down component 9*c* of a pointer 9, which necked down component serves to interconnect a stepped end part 9*d* to a body part 9*e* of the pointer 9. Lateral facing edge grooves 9*a* are provided on opposite lateral sides of the necked down component 9*c*. A projection 13*a* on a holding part 13 grips over the stepped end part 9*d*. The holding part 13 is fastened to the release plate 8*b*. The pointer 9 is, viewed in a top view, designed approximately T-shaped. A longitudinal groove 9*b* is provided in the underside of the pointer 9 at an end 9*j* remote from the release plate 8*b* and into which is guided the tongue 5*b* of the sleeve 5.

Figure 2B:
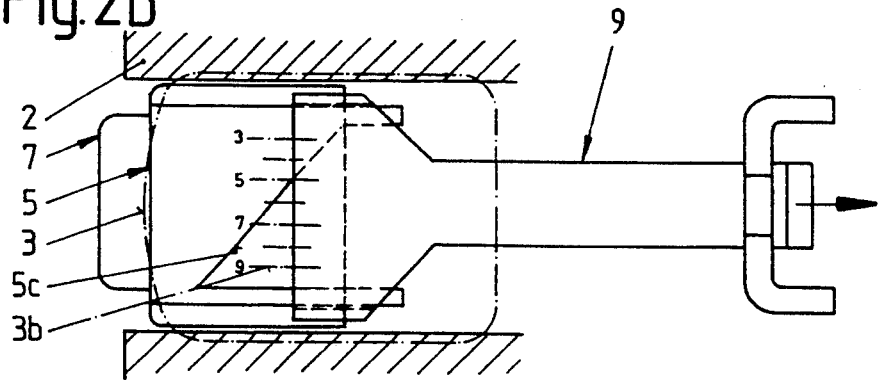
Figure 5:
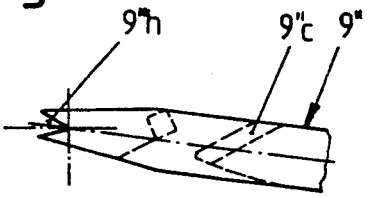
FIGS. 5 to 8 and 11 disclose modifications of the development of the pointer end.
Figure 6:
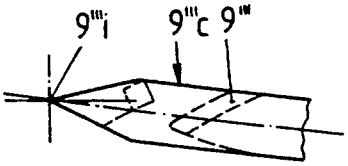
Figure 8:
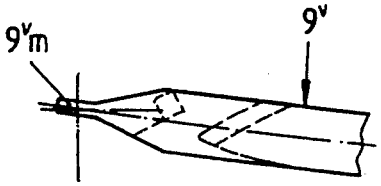

If the skier steps now with his ski shoe into the front jaw 1, which front jaw has two toggle levers 12*a*, 12*b* oriented at a toe end of the ski shoe, then the pull rod 8 and the sleeve 5 in FIG. 2*b* are moved slightly to the right, and the release spring 6 is compressed. The set value is, however, not changed by this movement.

Figure 3:
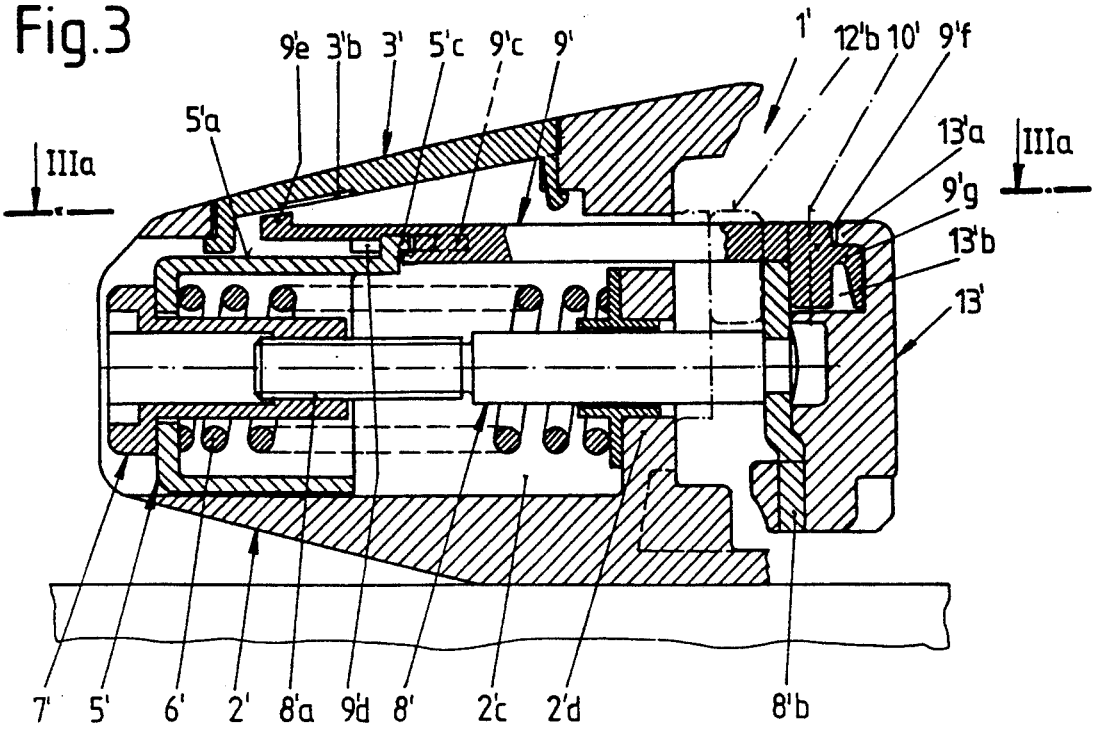
FIG. 3 is a vertical longitudinal center cross-sectional view of a second embodiment.
Figure 4:
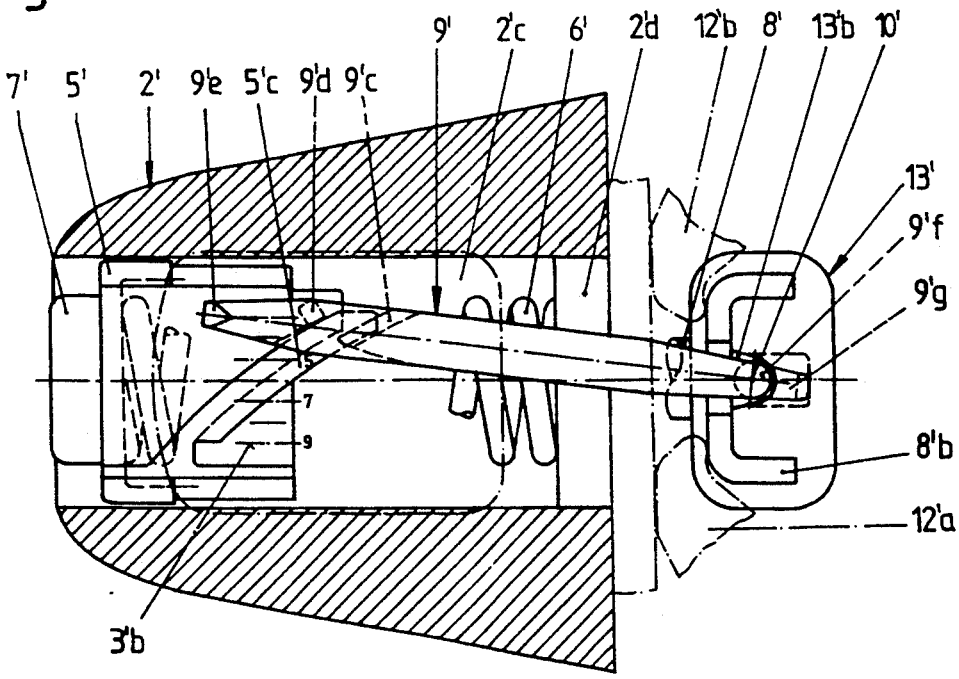
FIG. 4 illustrates a similar detail in which the initial tension of the release spring is adjusted to the value 3.
Figure 3A:
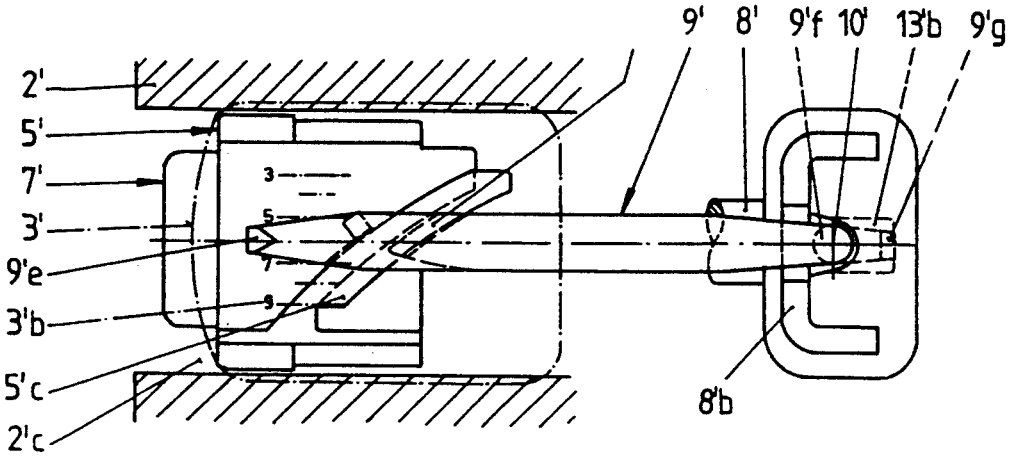
FIG. 3*a* is a cross-sectional view taken along the line III*a*—III*a* of FIG. 3 of a detail of the second embodiment, with the initial tension of the release spring being adjusted to the value 6.

The ski-binding part $1^I$ illustrated in FIGS. 3, 3*a* and 4 is similar to the first embodiment just described. It differs from the first embodiment primarily by the pointer $9^I$ having a hub $9^If$ being arranged pivotally relative to the release plate ($8^Ib$) about a vertical axis $10^I$ of the hub $9^If$. The pointer $9^I$ has, viewed in longitudinal cross section, a step surface, with a groove $9^Ic$ being recessed in the step surface. Opposing this groove $9^Ic$ is a bearing surface $9^Id$. An angularly extending guide rib $5^Ic$ is arranged on the upper side $5^Ia$ of the sleeve $5^I$ which rib is L-shaped in cross section and is received in the groove $9^Ic$. A frontwardly facing side of the guide rib $5^Ic$ rests on the bearing surface $9^Id$.

A further difference with respect to the design according to FIGS. 1 and 2 is that a pentagonal prism $9^Ie$ is formed on the free end of the pointer $9^I$, which prism is used to indicate the set value of the initial tension of the spring.

The spacing between the pointer $9^I$ and the window $3^I$ is reduced with the prism $9^Ie$ and reading is thus improved.

Finally, the embodiment according to FIGS. 3, 3*a* and 4 is distinguished by the hub $9^If$ having a shoulder $9^Ig$ defining a center of movement of the pointer $9^I$, over which shoulder grips a projection $13^Ia$ of a holding part $13^I$. A front facing wall of the holding part $13^I$ is fastened to the release plate $8^Ib$. A recess $13^Ib$ is provided below the projection $13^Ia$ to enable a pivoting of the pointer $9^I$ within pregiven limits.

The pointers according to FIGS. 5 to 8 can also be used in an advantageous manner in the embodiment of the front jaw $1^I$ according to FIGS. 3, 3*a* and 4. According to FIG. 5, the value is indicated by a V-shaped recess $9^{II}h$ in the case of the pointer $9^{II}$. In the case of the pointer $9^{III}$ illustrated in FIG. 6, the indication is accomplished by a tip $9^{III}i$. The pointer $9^{IV}$ according to FIG. 7 carries at its end a disk $9^{IV}k$ having in its center a marking $9^{IV}k_1$ in the form of a hole. Finally, the pointer $9^V$ illustrated in FIG. 8 does not terminate in a tip like the pointer $9^{II}$ but in a rectangular projection $9^Vm$, the longitudinal length of which extends in direction of the pointer axis.

Figure 9:
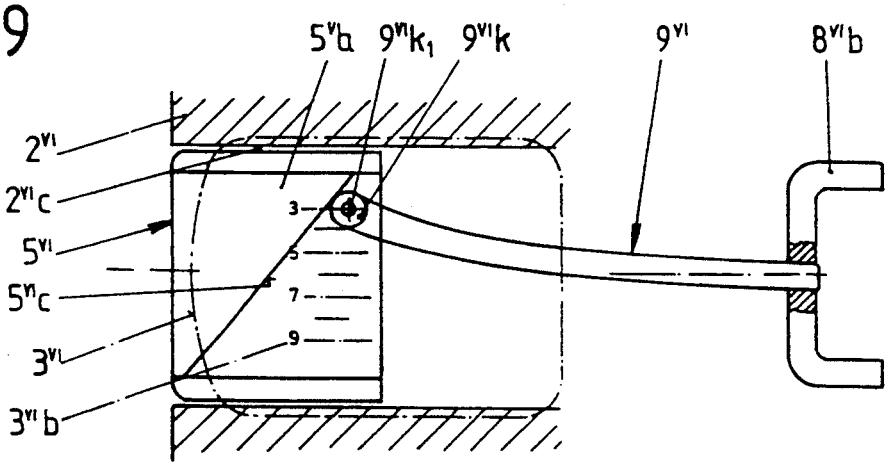
FIGS. 9 and 10 are, finally, illustrations of details of two further embodiments similar to FIGS. 2*a*, 2*b* and 3*a*.
Figure 10:
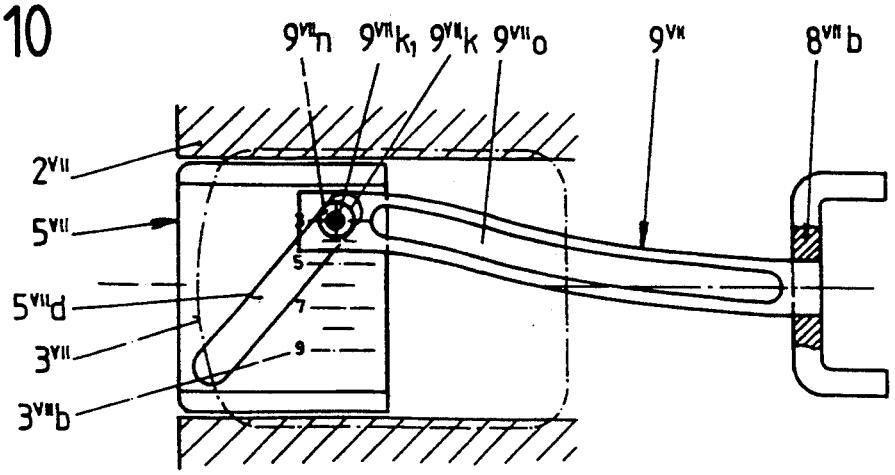
Figure 13:
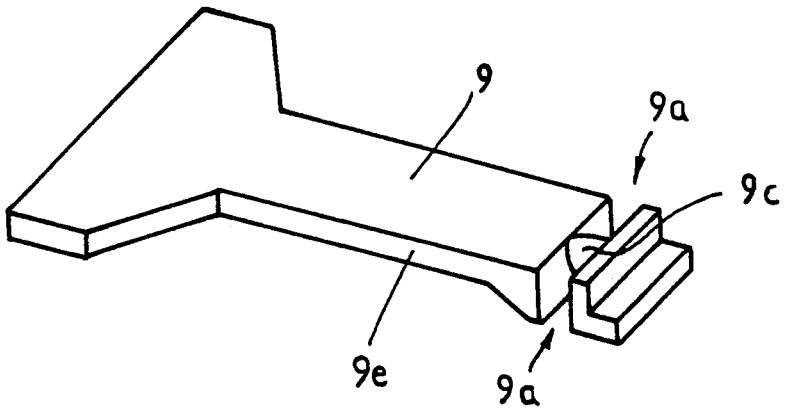
FIG. 13 is an isometric view of the pointer illustrated in FIGS. 1, 2, 2*a* and 2*b*.

Springs form the pointers $9^{VI}$ and $9^{VII}$ in the embodiments illustrated in FIGS. 9 and 10. This measure is actually already known as shown by AT-PS 323 619. The spring, which is curved archlike, is according to FIG. 2 of this reference fastened at one end to a housing, in which housing an adjusting screw for adjusting a release spring is supported. This adjusting screw is fastened to an annular disk which has steps on its periphery. The spring rests on one of these steps, the free end of which spring is associated with a housing-fixed scale.

If the adjusting screw is rotated now, then the point of support of the pointer changes and thus the position of the pointer end with respect to the scale.

The operation is basically different in the embodiment according to FIGS. 9 and 10. Thus, according to FIG. 9, the end of the pointer $9^{VI}$, designed as a leaf spring, is guided along an angular extending surface $5^{VI}c$ arranged on an upper side $5^{VI}a$ of the sleeve $5^{VI}$. The pointer end carries a disk $9^{VI}k$ with a marking $9^{VI}k_1$ between the end of the pointer $9^{VI}$ and the angular extending surface $5^{VI}c$.

A plane of a pointer $9^{VII}$ designed as a leaf spring lies, in the embodiment according to FIG. 10, parallel with respect to the plane of the scale $3^{VII}b$. The pointer $9^{VII}$ is rectangular in a top view and has an elongated slot $9^{VII}o$ extending in a longitudinal direction thereof so as to define a framelike shape. A downwardly extending pin $9^{VII}n$ is arranged on a transversely extending side of the frame, which pin is received in an angularly extending slot $5^{VII}d$ in a sleeve $5^{VII}$.

Figure 7:
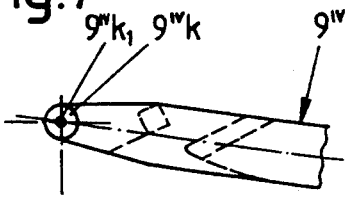

A disk $9^{VII}k$ with a marking $9^{VII}k_1$ similar to the embodiments according to FIGS. 7 and 9 is arranged on the upper side of the pointer $9^{VII}$.

Figure 11:
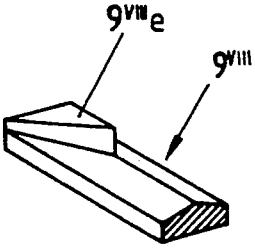

The end of the pointer $9^{VIII}$ illustrated in FIG. 11 is distinguished by the pointer $9^{VIII}$ having a roof-shaped upper side terminating in a pointer end $9^{VIII}e$ constructed as a prism. This improves the contrast of the pointer $9^{VIII}$ relative to the scale.

The invention is not to be limited to the exemplary embodiments illustrated in the drawings and described above. Rather many modifications are possible without departing from the scope of the invention. For example, embodiments in which the swingable rigid pointer is under the influence of a restoring spring also fall under the protection of the invention.

Furthermore, the construction of the pointer end, as it is illustrated in FIGS. 5 to 8, can also be used in the embodiments according to FIGS. 3, 4, 9 and 10. Furthermore, the spring in the embodiment according to FIG. 9 can also be designed as a spiral-torsion spring. Also increasing the contrast of the pointers according to FIG. 11 can be utilized with good success in other embodiments.

We claim:

1. In a front jaw for a safety ski binding including a housing adapted to be fastened to an upper side of a ski and having a rear cross wall extending transverse to a longitudinal axis of the ski, an elongated pull rod extending substantially along the longitudinal axis and having a first end disposed within the housing and a second end extending through a first bore in the rear cross wall, a rectangular cup-like sleeve disposed within the housing and opening toward the rear wall, an adjusting nut having a internally threaded hollow shank extending through a second bore in a base wall portion of the sleeve and threadably engaging the first end of the pull rod and rotatably supporting the sleeve, a release spring concentrically surrounding the pull rod and the threaded shank within the housing and disposed between the rear cross wall and the base wall of the sleeve, a release plate coupled to the second end of the pull rod, two toggle levers each having a short lever arm and a long lever arm, the release plate operatively coupling the pull rod to the short lever arms and the long lever arms laterally engaging a sole of an inserted ski boot, said toggle levers each being pivotally supported on the housing, a scale presenting indicia which indicate an adjustment number for a release force, a transparent window means on the housing, and a pointer associated with the scale, the improvement wherein the pointer includes a terminal end portion secured to the release plate and a free end portion remote from said terminal end portion, an upper surface on the sleeve including means for cooperating with said free end portion to define a point of intersection on the scale, said free end portion being proximate the transparent window means and the scale, and the indicia being arranged directly on the transparent window means of the housing and extending transverse to the longitudinal axis so that the proximately located free end will indicate selected indicia on the scale through the transparent window means.

2. The front jaw according to claim 1, wherein said means for cooperating includes a forked member having two spaced-apart tine portions extending from the upper surface of the sleeve toward the rear cross wall and an intermediate edge portion extending between said tines other than transverse with respect to the longitudinal axis, and wherein said free end portion of the pointer includes a free edge extending transversely with respect to the longitudinal axis, said free edge cooperating with said intermediate edge portion to define the point of intersection corresponding with the respective adjustment number on the scale.

3. The front jaw according to claim 2, wherein said free end portion of the pointer further includes a longitudinally extending groove on an underside thereof, said groove slidably receiving said tine portions of said forked member.

4. The front jaw according to claim 3, wherein said terminal end portion of the pointer includes a necked down part and a stepped end part, said necked down part being inserted into an upwardly open notch on the release plate, and a projection of a holding part attached to the release plate engaging said stepped end part.

5. The front jaw according to claim 1, wherein said means for cooperating includes a raised guide rib extending from the upper surface of the sleeve and arched with respect to the longitudinal axis, wherein said terminal end portion of the pointer includes a hub which is pivotal about a vertical axis, and wherein said free end portion of the pointer includes a groove on an underside thereof which receives said guide rib.

6. The front jaw according to claim 5, wherein said guide rib on the sleeve has an L-shaped cross section.

7. The front jaw according to claim 5, wherein said free end portion of the pointer further includes a stepped surface in which is recessed said groove, and a downwardly extending bearing surface disposed adjacent said guide rib remote from said groove.

8. The front jaw according to claim 7, wherein said free end portion of the pointer further includes an upwardly extending prism having one edge thereof intersecting a longitudinal axis of the pointer.

9. The front jaw according to claim 5, wherein said hub of the pointer includes a shoulder portion, and a projection of a holding part attached to the release plate engaging said shoulder portion.

10. The front jaw according to claim 5, wherein said free end portion of the pointer further includes a free edge defining a V-shaped recess.

11. The front jaw according to claim 5, wherein said free end portion of the pointer further includes a free edge having a disk attached thereto, said disk having a central opening therethrough.

12. The front jaw according to claim 1, wherein said engaging means includes an intermediate edge portion extending other than transverse with respect to the longitudinal axis, the pointer is a spiral spring-type pointer, and said free end portion of the pointer being supported on said intermediate edge portion.

13. The front jaw according to claim 12, wherein said free end portion of the pointer includes a free edge having a disk attached thereto, said disk having a marking which cooperates with the scale to indicate the respective adjustment number corresponding to a point of intersection therebetween.

14. The front jaw according to claim 1, wherein said means for cooperating includes a groove on the upper surface of the sleeve extending other than transverse with respect to the longitudinal axis, and wherein the pointer is a leaf-type spring which is rectangular in a top plan view and has a rectangular recess extending in a direction along a longitudinal axis of the pointer, said free end portion of the pointer including a pin extending from an underside thereof through said groove.

15. The front jaw according to claim 1, wherein said free end portion of the pointer is roof-shaped in a cross-sectional view and includes a triangular-shaped prism formed on a free edge thereof, said prism having an edge intersecting a longitudinal axis of the pointer.

* * * * *